US006676422B1

(12) United States Patent
Baker et al.

(10) Patent No.: US 6,676,422 B1
(45) Date of Patent: Jan. 13, 2004

(54) POWER CORD COMPOSITE THREADED SEALING CAP

(75) Inventors: Bryan C. Baker, Houston, TX (US); David W. Clem, Spring, TX (US); Darrell J. Weigelt, Seabrook, TX (US)

(73) Assignee: Drilltec Patents & Technologies Co., Inc., Houston, TX (US)

( * ) Notice: Subject to any disclaimer, the term of this patent is extended or adjusted under 35 U.S.C. 154(b) by 0 days.

(21) Appl. No.: 10/262,244

(22) Filed: Oct. 1, 2002

(51) Int. Cl.[7] ..... H01R 13/44
(52) U.S. Cl. ..... 439/135; 439/521
(58) Field of Search ..... 439/436, 202, 439/522, 135, 536, 519, 512, 521

(56) References Cited

U.S. PATENT DOCUMENTS

| | | | | |
|---|---|---|---|---|
| 3,287,687 A | | 11/1966 | Mosher | 339/36 |
| 3,372,361 A | | 3/1968 | Wengen | 339/97 |
| 3,633,150 A | | 1/1972 | Swartz | 339/36 |
| 4,647,717 A | * | 3/1987 | Uken | 174/84 C |
| 4,674,820 A | * | 6/1987 | Foster et al. | 439/522 |
| 4,902,238 A | | 2/1990 | Iacobucci | 439/135 |
| 4,952,160 A | | 8/1990 | Olsen | 439/142 |
| 4,973,448 A | * | 11/1990 | Carlson et al. | 422/9 |
| 5,844,021 A | | 12/1998 | Koblitz et al. | 523/173 |
| 6,065,981 A | | 5/2000 | Sopotnick et al. | 439/135 |
| 6,083,016 A | | 7/2000 | Waynick, Sr. | 439/135 |
| 6,142,805 A | | 11/2000 | Gray et al. | 439/206 |
| 6,300,574 B1 | | 10/2001 | Franey | 174/138 |

* cited by examiner

*Primary Examiner*—Neil Abrams
*Assistant Examiner*—Phuong Dihn
(74) *Attorney, Agent, or Firm*—Mark E. Scott; Conley Rose, P.C.

(57) ABSTRACT

The specification discloses a cap for sealing the terminal end of a power cord, such as a marine power cord, against dirt and moisture. The specification also discloses that the cap actively prevents corrosion of the electrical contacts covered by the cap by the inclusion of corrosion-inhibiting compounds dispersed within the plastic of the cap. The corrosion-inhibiting compound are released in gaseous form within the cap, thereby inhibiting corrosion of the electrical contacts.

31 Claims, 4 Drawing Sheets

POWER CORD COMPOSITE THREADED SEALING CAP

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

1. Field of the Invention

The preferred embodiments of the present invention relate generally to electrical power cords. More particularly, the preferred embodiments relate to a sealing cap for the end of an electrical power cord. More particularly still, the preferred embodiments relate to a moisture-resistant corrosion-inhibiting threaded sealing cap for use with an onshore power cord in marine applications.

2. Background of the Invention

When docked, a marine vessel generally requires a source of electricity other than its own batteries in order to enable operation of electrical appliances onboard without depleting the batteries. Electrical power is typically provided from an onshore power supply to a receptacle on the boat via a marine power cord. However, marine power cords are prone to wetness and resultant corrosion due to the risk of precipitation and proximity to water.

Preventing moisture from contacting the electrical connections, including the receptacles and terminal end of the power cord, is of utmost importance. Salt water is especially damaging to electrical connections, as dissolved salt increases the conductivity of the aqueous solution formed at the surface of a metal and enhances the rate of electrochemical corrosion. In addition, using a wet power cord is dangerous due to the risk of electrical shock or shorting. If moisture were to enter the connection when electricity is flowing, the connection could short out, potentially tripping the breaker of the onshore power supply.

Many boaters cover the ends of marine power cords by placing a plastic bag over the terminal end and securing the end of the bag to the cord with a rubber band or twist tie. Although this method largely prevents moisture intrusion, a bag is not always handy and is not quickly and easily installed and removed. In addition, this method does nothing to prevent corrosion due to humidity build-up or small amounts of moisture. Moreover, this method does not structurally protect the terminal end from mechanical damage, such as being stepped on or crushed by equipment, which could occur if left unprotected.

There have been attempts in the related art to slow corrosion in electrical connectors. For example, U.S. Pat. No. 3,372,361 to Wengen appears to disclose the use of a corrosion inhibitor in gel form within a cavity where two dissimilar metals meet. Likewise, U.S. Pat. No. 5,844,021 to Koblitz discloses a corrosion inhibitor in a gel form in the Koblitz connectors. Each of Wengen and Koblitz may be characterized in that the corrosion inhibitor must be in contact with the conductors where the anti-corrosion properties are desired. U.S. Pat. No. 6,300,574 to Franey discloses an electrical cap that contains sacrificial metals with which corrosives react, thus protecting to some extent remaining electrical components within the cap.

The Wengen and Koblitz techniques, utilizing a gel, are simply not suitable for use in marine power cord and related applications. The Franey technique of placing sacrificial metals within the polymer cap is only a passive technique, and thus may not provide sufficient protection in corrosive environments, such as marine applications.

Thus, what is needed in the art is a cap for electrical connectors, such as marine power cords, that is convenient to use, that is not easy to lose, and that more aggressively protects the electrical connectors within the power cord from corrosion.

BRIEF SUMMARY OF SOME OF THE PREFERRED EMBODIMENTS

The problems noted above are solved in large part by a cap and related method for sealing the terminal end of a marine power cord against moisture. More particularly, the preferred embodiments are directed to a cap that seals the terminal end of a marine power cord against dirt and moisture, and where the cap inhibits corrosion of the electrical connections. The preferred embodiments relate to a positively buoyant plastic cap having a threaded section for mating to a corresponding section on the terminal end of a power cord, forming a moisture-proof seal. The preferred embodiments also comprise a corrosion-inhibiting compound dispersed within the plastic material of the cap. An alternate embodiment includes a cap having a corrosion-inhibiting compound integrally dispersed within a plastic insert coupled inside the cap. The corrosion-inhibiting compound is released from the composite plastic cap, or composite plastic insert, in gaseous form actively preventing corrosion of the electrical contacts of the power cord.

The disclosed devices and methods comprise a combination of features and advantages which enable it to overcome the deficiencies of the prior art. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will made to the accompanying drawings in which.

DETAILED DESCRIPTION OF THE PREFERRED EMBODIMENTS

Figure 1A:
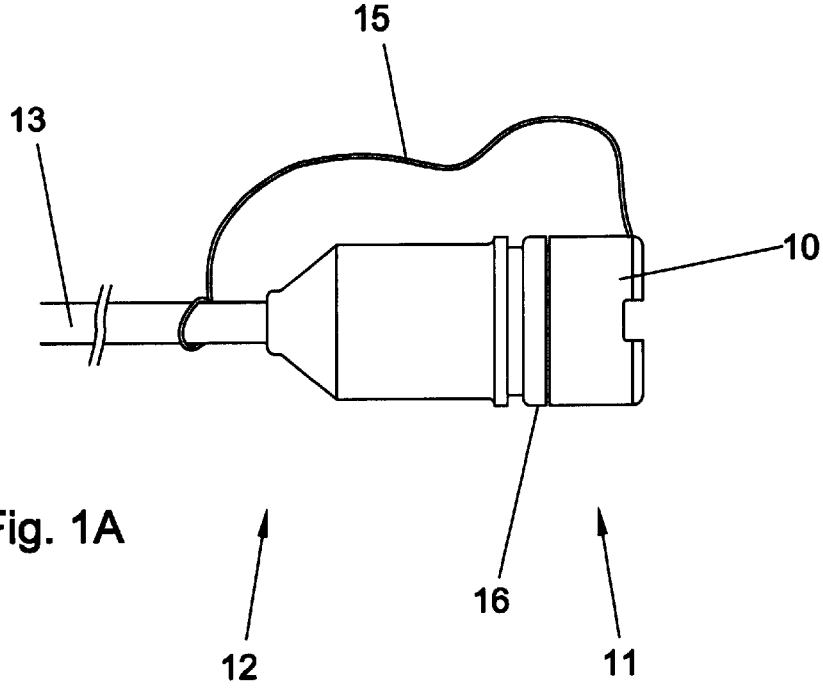
FIG. 1A shows an elevation view of an embodiment engaged with the terminal end of a conventional power cord.
Figure 1B:
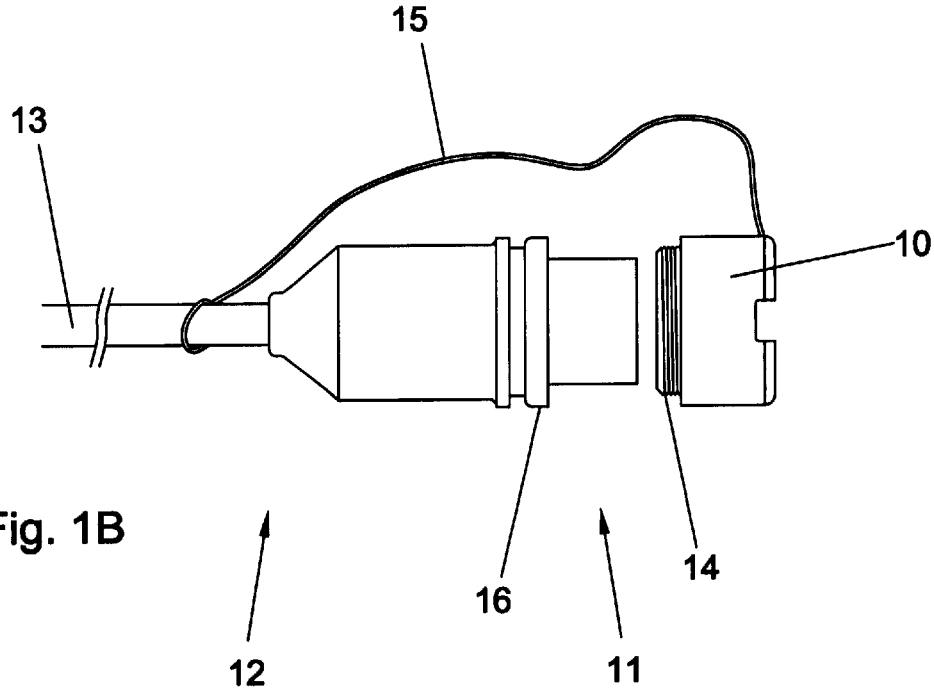
FIG. 1B shows an embodiment of the present invention disengaged from the terminal end of a conventional power cord.

The preferred embodiments are directed to a power cord sealing cap which overcomes many deficiencies of the prior art. FIGS. 1A and 1B show a first embodiment in engaged and disengaged positions, respectively, with a conventional marine power cord assembly 12. Before proceeding, it must be understood that the preferred embodiments were developed in the context of marine power cords for transfer of power from the shore to the vessel, and therefore they will be described in that context; however, the systems and methods described find application outside the marine power cord context, and thus the description in this manner should not be construed as a limitation as to the breadth of the invention. Referring to FIG. 1A, male power cord sealing cap 10 is shown engaged with terminal end 11 of power cord 12, which further includes cable portion 13. The power cord has an outer protective jacket that protects a plurality of metallic conductors therein. The metallic conductors electrically couple to metallic contacts in the terminal end 11 of the power cord. When in use, terminal end 11 plugs into an onboard electrical receptacle (not shown). If left uncovered while not in use, the electrical contacts in the power cord terminal end 11 could be damaged, soiled or become wet, potentially affecting the operation of the electrical connections in the terminal end. Using a wet electrical power cord 12 is particularly dangerous, since water on the cord surface could potentially conduct current. In addition to water or other liquids that may contact the electrical connections on terminal end 11, humidity present in the air could potentially corrode the electrical contacts even when enclosed within cap 10.

Cap 10 is preferably tubular in nature, has a substantially circular cylindrical cross-section, and is made of a polymeric thermoplastic material, such as high density polyethylene (HDPE). When engaged, the cap substantially protects the power cord terminal end 11 from impact, dirt, moisture and ensuing corrosion. In addition, the cap 10 of the preferred embodiments is positively buoyant in water, with a specific gravity of less than approximately 0.98, less than that of salt or fresh water, so that it floats and is easily retrieved should it fall.

Referring now to FIG. 1B, cap 10 includes an externally threaded male connection 14 that engages corresponding internally threaded female connecting ring 16 on terminal end 11, forming a substantially secure and moisture-resistant seal. In addition, unlike the sliding fits of some related art caps, the threaded connection between cap 10 and power cord 12 requires manual force in order to be disengaged. Cap 10 is preferably linked to cable portion 13 of cord 12 by a lanyard 15 comprised of any suitable material such as strong plastic, small chain and the like, thereby preventing unintentional loss.

Figure 2A:
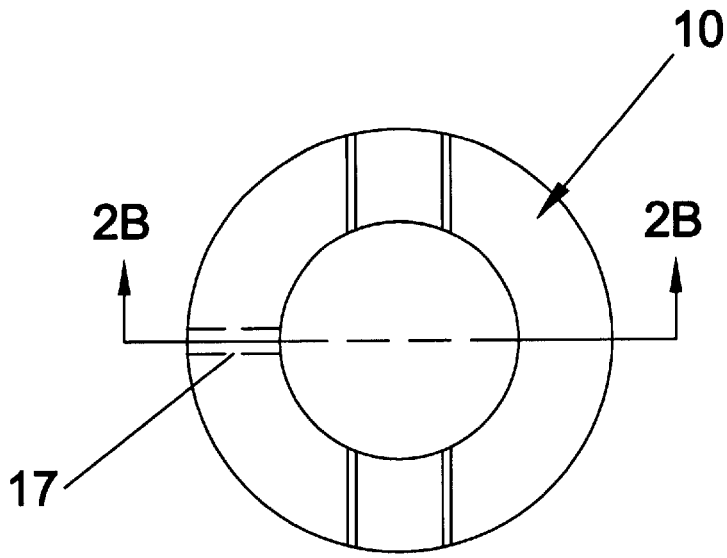
FIG. 2A shows a top view of an embodiment of the present invention.
Figure 2B:
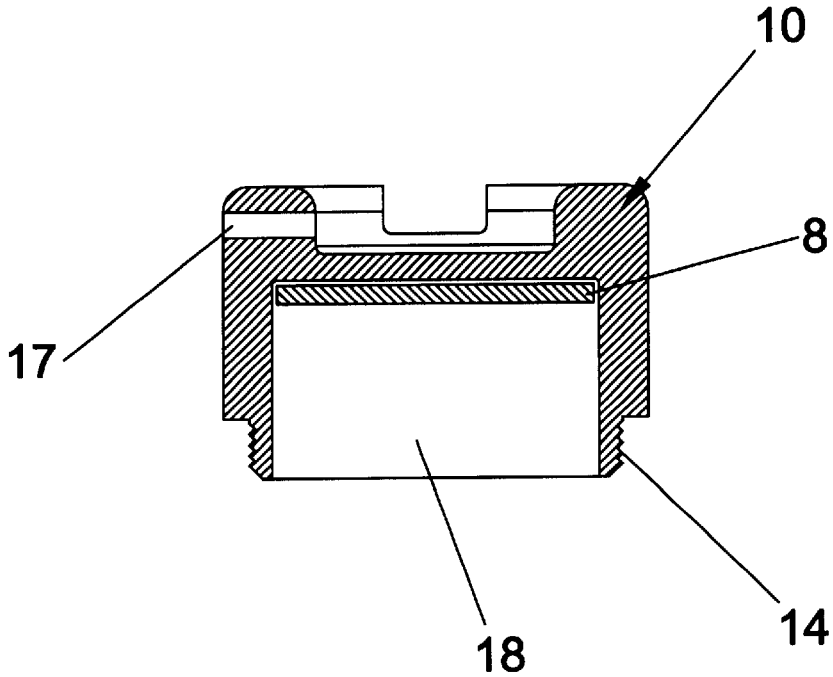
FIG. 2B shows a sectional view of an embodiment of the present invention.

FIG. 2A shows a top view of an embodiment of male power cord sealing cap 10, which includes hole 17 for attaching the lanyard or other mechanisms that could securely linking the cap to a power cord. FIG. 2B shows a side view of cap 10 taken along line 2—2 of FIG. 2A. Cap 10 includes cavity 18 in which the terminal end or connector of a power cord (not shown) is enclosed. Threads 14 are designed to engage with a typical internally threaded connecting ring 16 located on terminal end 11, thereby forming a moisture-proof seal.

Figure 3A:
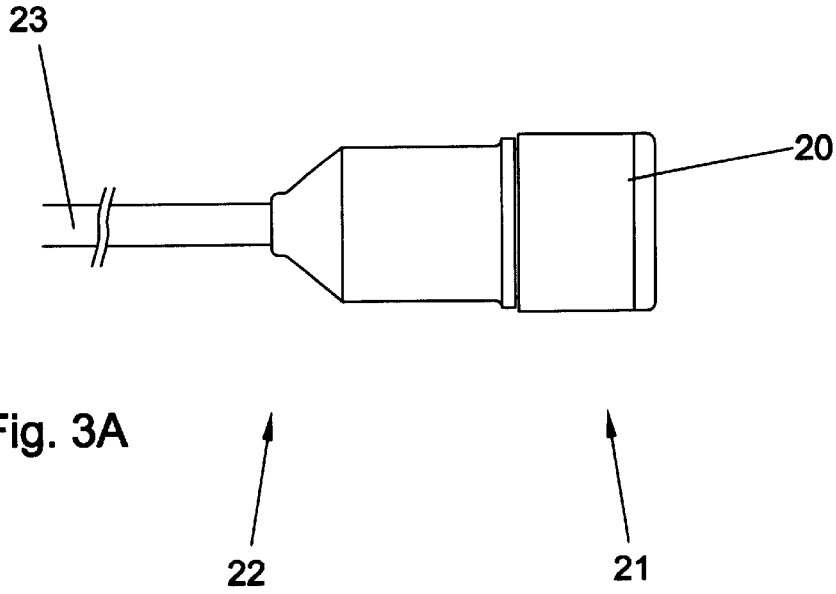
FIG. 3A shows an elevation view of an alternate embodiment engaged with the terminal end of a conventional power cord.
Figure 3B:
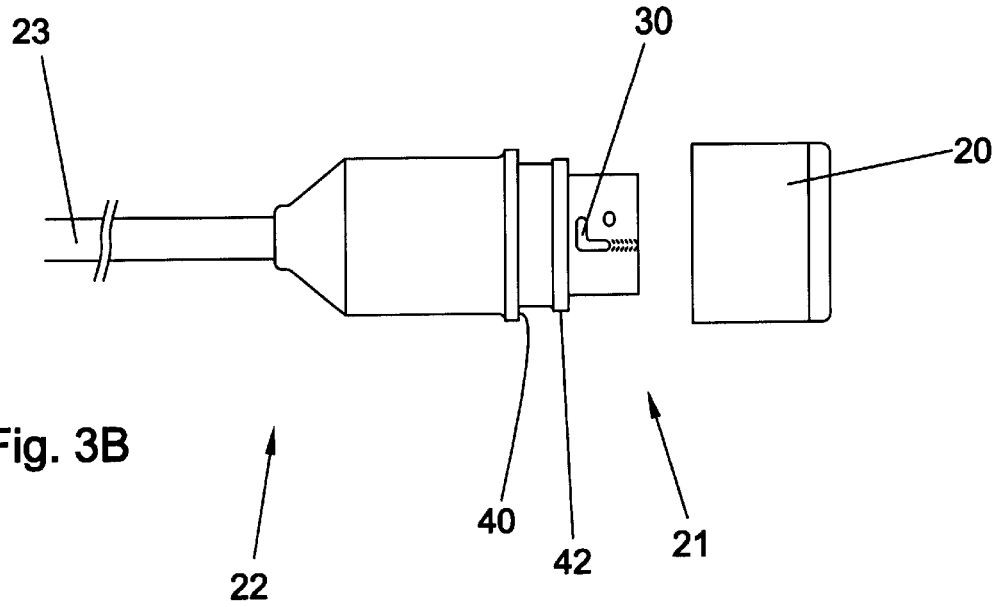
FIG. 3B shows an alternate embodiment disengaged from the terminal end of a conventional power cord.

FIGS. 3A and 3B show an alternate embodiment in engaged and disengaged positions, respectively, with conventional power cord 22. Referring now to FIG. 3A, female power cord sealing cap 20 is shown engaged with terminal end 21 of male power cord 22, which further includes cable portion 23. Cap 20 is designed to engage terminal end 21, which has a double-lead "L"-shaped thread 30 (only one shown in FIG. 3B) which when engaged with corresponding threads in cap 20 holds the cap in place. In this alternate embodiment, sealing of the terminal end 21 takes place between shoulder 40 and a corresponding location 44 (FIG. 4B) of cap 20. Additionally, surface 42 may form a friction-type fit with surface 46 (FIG. 4) of the cap 20. It will be understood that, while the sealing caps of the preferred embodiments have been shown to engage typical threaded and L-lock-shaped threaded terminal ends, many variations in the thread design are possible without departing from the scope and spirit of the invention.

Figure 4A:
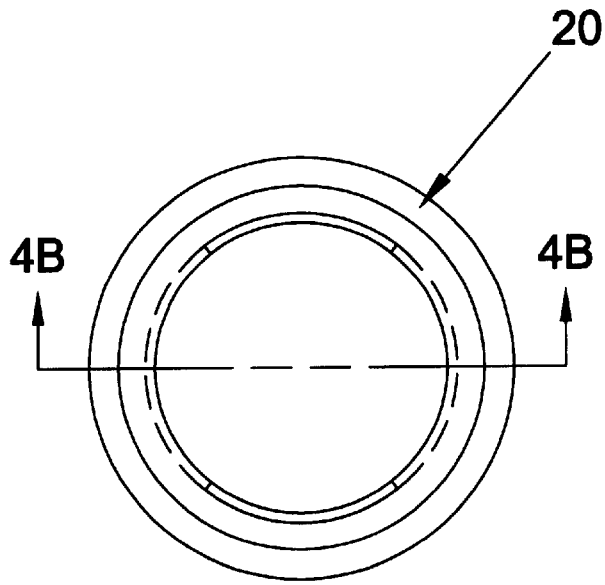
FIG. 4A shows a bottom view of an alternate embodiment of the present invention.
Figure 4B:
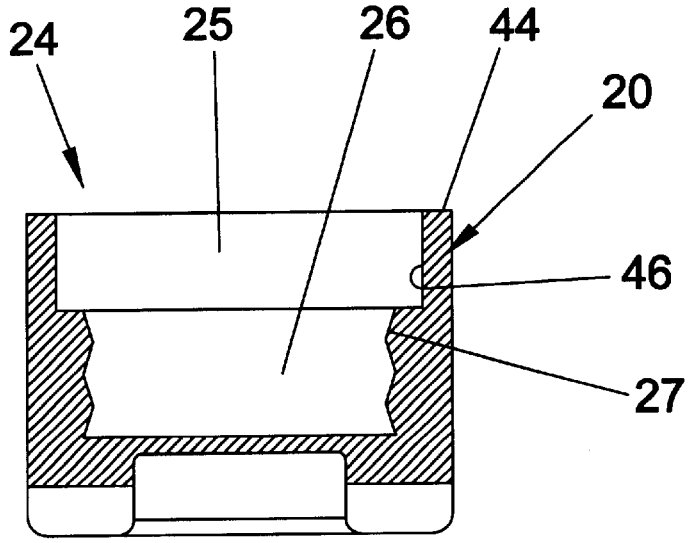
FIG. 4B sectional view of an alternate embodiment.

FIG. 4A shows a bottom view of the embodiment of female power cord sealing cap 20 for covering a male terminal end (not shown). FIG. 4B shows a side view of cap 10 taken along section 4B—4B of FIG. 4A. Cap 20 includes internal cavity 24 in which the terminal end of a male power cord may be enclosed. Cavity 24 typically includes a wider opening section 25 and a narrower internal section 26 having an internally threaded portion 27 for engaging an externally threaded section of a male terminal end (such as double-lead —"L"—shaped thread 30 of FIG. 3B).

Since ambient humidity may become trapped inside a power cord sealing cap when engaged with the terminal end of the power cord, the moisture-resistant seal alone may not be sufficient to protect against corrosion of the electrical connections. Over time, humidity and condensation inside the cap may contribute to corrosion, thus, the preferred embodiments actively inhibit corrosion within a power cord sealing cap.

The preferred embodiments comprise a corrosion-inhibiting material dispersed within plastic material of the power cord sealing cap, forming a composite cap material. The material of the preferred embodiments is polyethylene integrally incorporating a plastic-additive corrosion inhibitor in solid form that is released as in gaseous form inside the cap. Any corrosion inhibitor that can be dispersed within the preferred material is suitable, such as a plastic additive marketed under the trade name M-226 MF Masterbatch by Cortec Corporation. Using the Cortec Corporation material, the additive should represent 2.5% of the volume of the cap material. In an alternative embodiment, the cap may be a homogeneous polyethylene cap that comprises a composite corrosion-inhibiting insert 8 (FIG. 2B) coupled within the cap. In this embodiment, as the corrosion-inhibiting agent is depleted, the insert 8 may be removed and replaced, thereby extending the useful life of the cap 10.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A sealing cap for a power cord, the sealing cap made of a polymeric thermoplastic material and having a corrosion-inhibiting compound integrally dispersed within a portion of the polymeric thermoplastic material, and wherein the corrosion-inhibiting compound is released within the sealing cap to inhibit corrosion of electrical contacts of the power cord.

2. The sealing cap as defined in claim 1 further comprising a threaded sealing portion, and wherein the sealing cap forms a substantially moisture-resistant seal with a terminal end of the power cord.

3. The sealing cap as defined in claim 2 wherein the threaded sealing portion is disposed on an outer surface of the sealing cap.

4. The sealing cap as defined in claim 2 wherein the threaded sealing portion is disposed on an inner surface of the sealing cap.

5. The sealing cap as defined in claim 1 wherein the polymeric thermoplastic material is polyethylene.

6. The sealing cap as defined in claim 1 wherein the polymeric thermoplastic material has a specific gravity of less than 0.98.

7. The sealing cap as defined in claim 1 wherein the corrosion-inhibiting agent is M-226 MF Masterbatch manufactured by Cortec Corporation.

8. The sealing cap as defined in claim 1 wherein the corrosion-inhibiting compound is integrally dispersed within an insert coupled within the sealing cap.

9. The sealing cap as defined in claim 1 wherein the sealing cap is adapted for use on a marine power cable that supplies power from shore to a vessel, the sealing cap used when the marine power cable is disconnected.

10. The sealing cap as defined in claim 1 further comprising a lanyard coupling the sealing cap to the power cable.

11. A cap for use with a marine power cable comprising:

a tubular body having a substantially circular cross-section, the tubular body having a closed end, wherein the tubular body, closed end and open end define an internal cavity;

a set of threads on an outer surface of and proximate to the open end of the tubular body, the set of threads adapted to threadingly couple to a set of threads on the marine power cable, and wherein when the set of threads on the cap are threadingly coupled to the set of threads on the marine power cable, a portion of the distal end of the marine power cable extends into the internal cavity of the cap, and the cap forms a substantially water resistant seal with the marine power cable; and wherein the tubular body comprises plastic material, a portion the plastic material has dispersed therein a corrosion-inhibiting compound, and wherein the corrosion-inhibiting compound is released in gaseous form in the internal cavity of the cap.

12. The cap as defined in claim 11 wherein the portion of plastic material having the corrosion-inhibiting compound dispersed therein further comprises a plastic insert having the corrosion-inhibiting compound dispersed therein, the plastic insert coupled to the tubular body in the internal cavity.

13. The cap as defined in claim 11 wherein the plastic material of the tubular body is polyethylene.

14. The cap as defined in claim 13 wherein the polyethylene has a specific gravity of less than 0.98.

15. The cap as defined in claim 11 further comprising a lanyard coupled to the body, the lanyard adapted to couple to the marine power cable.

16. A cap for use with a marine power cable comprising:

a tubular body having a substantially circular cross-section, the tubular body having a closed end and an open end, wherein the tubular body, closed end and open end defining an internal cavity;

a set of threads on an inner surface of the tubular body proximate to the closed end, the set of threads adapted to threadingly couple to the marine power cable, and wherein when the set of threads on the cap are threadingly coupled to the marine power cable, a portion of the open end of the tubular body forms a substantially water resistant seal with the marine power cable; and wherein the body comprises plastic material, a portion the plastic material has dispersed therein a corrosion-inhibiting compound, and wherein the corrosion-inhibiting compound is released in gaseous form in the internal cavity of the cap.

17. The cap as defined in claim 16 wherein the portion of plastic material having the corrosion-inhibiting compound dispersed therein further comprises a plastic insert having the corrosion-inhibiting compound dispersed therein, the plastic insert coupled to the body in the internal cavity.

18. The cap as defined in claim 16 wherein the plastic material of the body is polyethylene.

19. The cap as defined in claim 18 wherein the polyethylene has a specific gravity of less than 0.98.

20. The cap as defined in claim 16 further comprising a lanyard coupled to the body, the lanyard adapted to couple to the marine power cable.

21. A method of using a marine power cable coupling power from shore to a vessel comprising:

disconnecting the marine power cable from the vessel;

placing a sealing cap over the terminal end of the marine power cable, and wherein the sealing cap forms a water-resistant seal with the terminal end of the marine power cable;

releasing corrosion-inhibiting compounds in gaseous form from a material integrally dispersed with the corrosion-inhibiting compounds within the sealing cap; and thereby inhibiting corrosion of electrical contacts on the marine power cable while in a disconnected state.

22. A method of using a marine power cable coupling power from shore to a vessel comprising:

disconnecting the marine power cable from the vessel;

placing a sealing cap over the terminal end of the marine power cable, wherein the sealing cap forms a water-resistant seal with the terminal end of the marine power cable;

releasing corrosion-inhibiting compounds in gaseous form within the sealing cap; and thereby inhibiting corrosion of electrical contacts on the marine power cable while in a disconnected state;

wherein placing a sealing cap and releasing corrosion-inhibiting compounds further comprise utilizing the sealing cap made of plastic material, a portion of the plastic material having dispersed therein the corrosion-inhibiting compounds in solid form, and wherein the corrosion-inhibiting compounds is slowly released from the plastic material by vaporization.

23. The method as defined in claim 22 wherein utilizing the sealing cap made of plastic material further comprises utilizing the sealing cap made of polyethylene material.

24. The method as defined in claim 22 wherein utilizing the sealing cap made of plastic material, a portion of the plastic material having dispersed therein the corrosion-inhibiting compound further comprises utilizing the sealing cap having an insert coupled therein that has the corrosion-inhibiting compound dispersed therein.

25. The method as defined in claim 24 further comprising replacing the insert when the corrosion-inhibiting compound is depleted.

26. A power cord comprising:

a cable having an outer protective jacket and a metallic conductor therein;

a connector on a terminal end of the cable housing a metallic electrical contact coupled to the metallic conductor;

a plastic cap adapted to form a water-resistant connection with the connector when the cap is placed over the connector;

a lanyard coupled on one end to the cap and on a second end to the cable; and wherein a portion of the plastic cap has dispersed therein a corrosion-inhibiting agent that is released in vapor form within the plastic cap when placed over the connector, and wherein the corrosion-inhibiting agent in vapor form inhibits corrosion of the metallic electrical contact.

27. The power cord as defined in claim 26 wherein said power cord further comprises a marine power cord for coupling power from shore to a vessel.

28. The power cord as defined in claim 26 further comprising:

wherein the cable further comprises a plurality of metallic conductors adapted to carry electrical power;

wherein the connector further comprises a plurality of metallic electrical contacts coupled one each to the plurality of metallic conductors; and wherein the plastic cap forms a water-resistant seal covering all the plurality of metallic electrical contacts when placed over the connector, and wherein the corrosion-inhibiting agent inhibits corrosion of the plurality of metallic electrical contacts.

29. The power cord as defined in claim 26 wherein the connector further comprises a threaded female connecting ring surrounding the connector, and wherein the cap further comprises an externally threaded male connection adapted to threadingly couple to the threaded female connecting ring when the cap is placed over the connector.

30. The power cord as defined in claim 26 wherein the connector further comprises a double-lead-"L" shaped thread, and wherein the cap further comprises an internally threaded female connection adapted to threadingly couple to the thread on the connector.

31. The power cord as defined in claim 26 wherein the portion of the plastic cap that has dispersed therein the corrosion-inhibiting agent further comprises an insert having dispersed therein the corrosion-inhibiting agent, the insert coupled within the cap.

* * * * *